United States Patent [19]

Sell

[11] Patent Number: 5,037,020

[45] Date of Patent: Aug. 6, 1991

[54] RIVETING MACHINE

[75] Inventor: Jean Sell, La Ferriere, France

[73] Assignee: 501 Recoules Automation, France

[21] Appl. No.: 304,682

[22] Filed: Jan. 31, 1989

[51] Int. Cl.[5] ..... B21J 15/10; B21J 15/20

[52] U.S. Cl. ..... 227/58; 227/51; 227/114; 227/149

[58] Field of Search ..... 227/2, 3, 4, 5, 110, 227/111, 51, 52, 53, 54, 55, 56, 57, 58, 156

[56] References Cited

U.S. PATENT DOCUMENTS

| | | | |
|---|---|---|---|
| 3,747,193 | 7/1973 | Gregory | 227/51 |
| 4,180,195 | 12/1979 | Coley et al. | 227/51 |
| 4,515,302 | 5/1985 | Davern et al. | 227/57 X |
| 4,548,345 | 10/1985 | Puritz et al. | 227/111 X |
| 4,615,473 | 10/1986 | Taga | 227/149 X |
| 4,662,556 | 5/1987 | Gidlund | 227/51 X |

*Primary Examiner*—Paul A. Bell

*Attorney, Agent, or Firm*—Thomas A. O'Rourke

[57] ABSTRACT

A device for combined drilling and riveting of a type including a "C"-shaped support frame. According to the invention, the means for drilling (14) and the rivet set (69) are arranged in a manner such that they may travel in directions which are at an angle in relation to the axis of the combined drilling/riveting head, the necessary pressure being supplied by two arms (2,3) driven by hydraulic jacks and the parts to be assembled (A,B) clamped one against the other by the jaws (6,7) of a plate grip throughout the operating cycle.

11 Claims, 6 Drawing Sheets

RIVETING MACHINE

Figure 1:
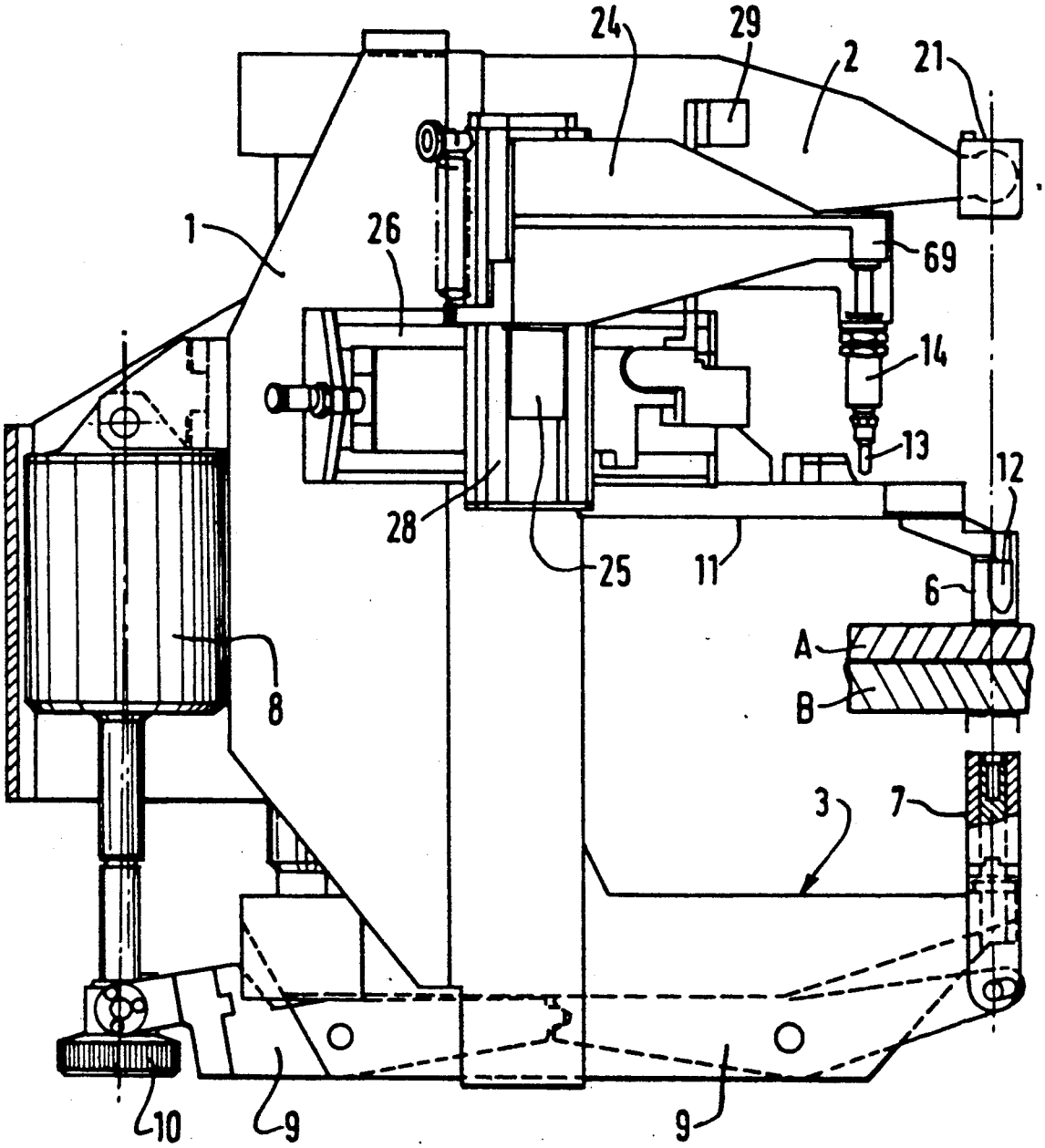

The invention described herein is a new apparatus combining drilling and riveting operations intended particularly but not exclusively for use in the aeronautic industry.

Riveting is a procedure used for the assembly or joining of components, usually metallic. It involves the steps of drilling a hole through the two components to be joined one to the other, and inserting a rivet into the hole thus formed. This rivet often possesses a preformed head on one end, the second head is subsequently created by plastic deformation induced by compressing the other extremity of the rivet. This plastic deformation is most often the result of the application of a strong pressure from end to end of the rivet. Given the forces to be applied in the formation of rivet heads and the dimensions of the components to be riveted, traditional riveting machinery usually falls into the category of heavy plant, necessitating not only very considerable investment but also extensive premises for installation and operation.

An object of the invention described herein is to provide a riveting device with a working head having a forward part of reduced size allowing work to be done automatically in difficult positions and in particular inside angles of 90°. Combined drill/rivet presses of conventional design do not allow the desired tasks to be carried out automatically in such positions. In conventional combined drill/rivet presses the drilling and riveting operations must be carried out using manually operated portable tools. In conventional presses the operation is broken up into separate phases; drilling, insertion of sealant, manual introduction of rivet and rivet compression. The separation into individually discrete phases results in a lengthy—and therefore costly operation.

FR-A-2 532 205 describes a riveting press mounted on a supporting or lifting bracket comprising the following: a drill head, a rivet feeder device and a riveting head. The supporting bracket may be coupled to a robot or an analogous device. However, the riveting head in this French patent consists of a pincer device, which does not permit the operator to maintain a constant correct position throughout the operating cycle of the attachments. In addition, U.S. patent application No. 4,180,195 describes a combined drilling and riveting press incorporating a device for the automatic supply of rivets. This latter document involves a machine of conventional design having particular means of feeding rivets to the riveting head.

Given the necessity of including a thrust block against which the second head of the rivet is formed, the present invention possesses a C-shaped configuration, one arm of which applies the pressure and the other the necessary counter-pressure to form the rivet.

This machine may of course be used as a fixed device on a bench, as a fixed device mounted on an overhead bracket crane or suspended from a balanced arm. However, the present invention is particularly advantageous if it is mounted on a supporting base whose movement in relation to the parts to be assembled may be programmed by means of a computerized controlling device. The spatial relationship between component being riveted and the machine therefore remains constant throughout a working cycle and the part to be riveted may itself be mobile if desired.

According to the invention described here, the combined drilling/riveting device, which is of a type incorporating a drilling/riveting press possessing a C-shaped configuration, has the distinctive feature of a head equipped with two arms powered by hydraulic jacks, one upper and one lower, which are fitted in such a way as to be able to slide along tracks to exert pressure on the tools; the components to be attached are held in position throughout the operating cycle between the jaws of a plate grip powered by a compressed-air thrustor. The device incorporates therefore various compressed air thrustors for the positioning of the various working parts of the machine and hydraulic jacks for the application of the pressure necessary for the drilling operation and the compression setting of the rivet.

The device described in this invention may be used as a drilling machine alone, as a riveting press alone with prior drilling of the necessary rivet holes, or it may be used more generally as a combined drill and riveting press. The uses to which the machine may be put are implemented by means of computer control board.

A further distinctive feature of this invention is that the drill head and the rivet set are mounted on slides giving them the possibility of translational motion in respect to the above-mentioned arms along axes forming an angle of less than 90°. In this manner, the tracks along which the slides travel form a V-shaped configuration, along the two arms of which the tools are able to run. This arrangement allows the riveting head to carry out assembly work in difficult positions.

Figure 2:
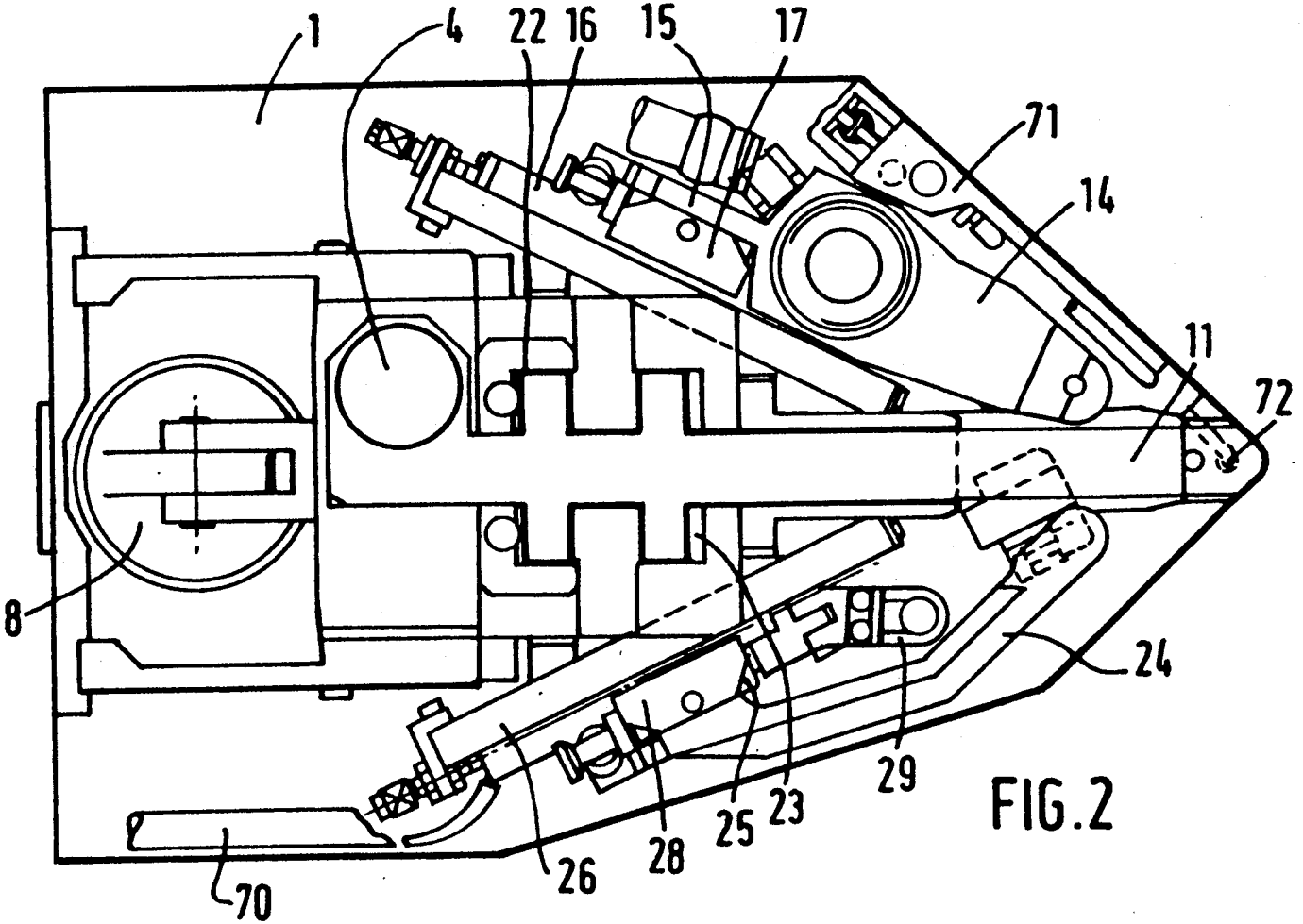
Figure 3:
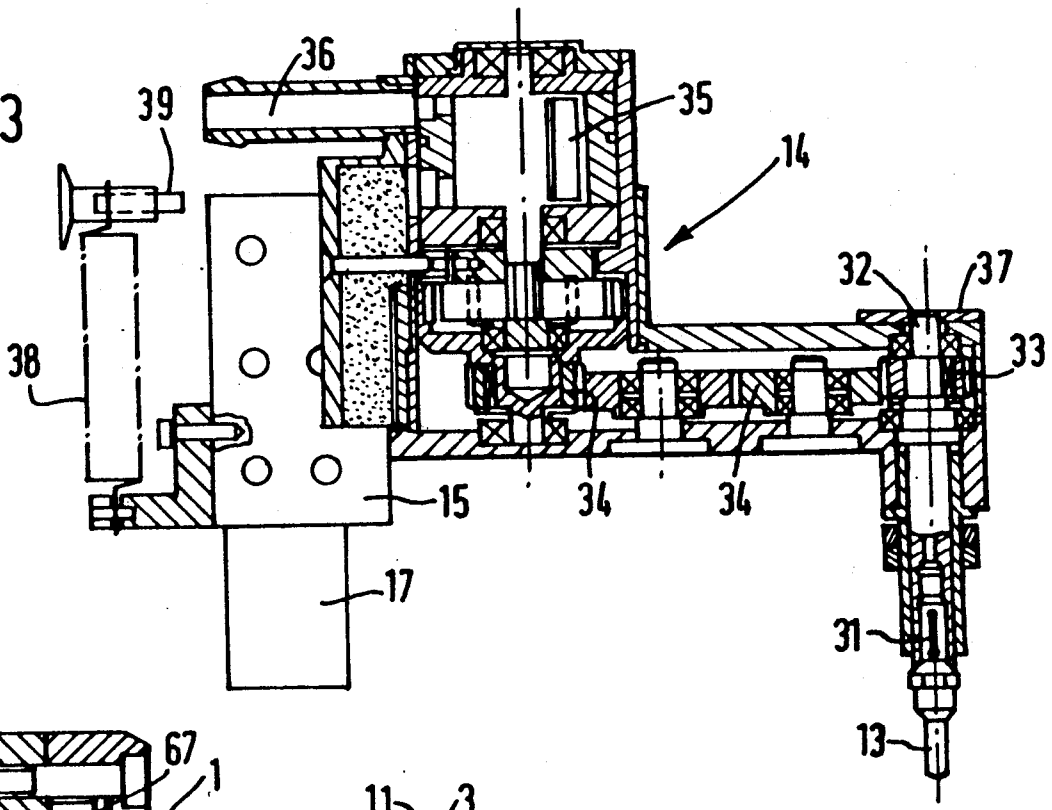
Figure 8:
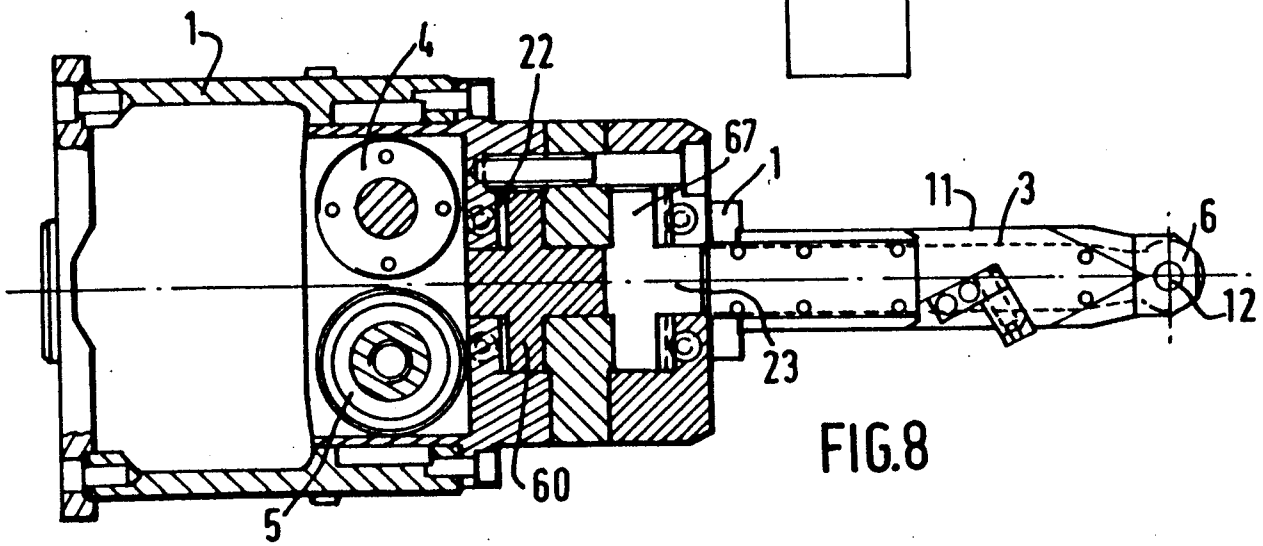
Figure 4:
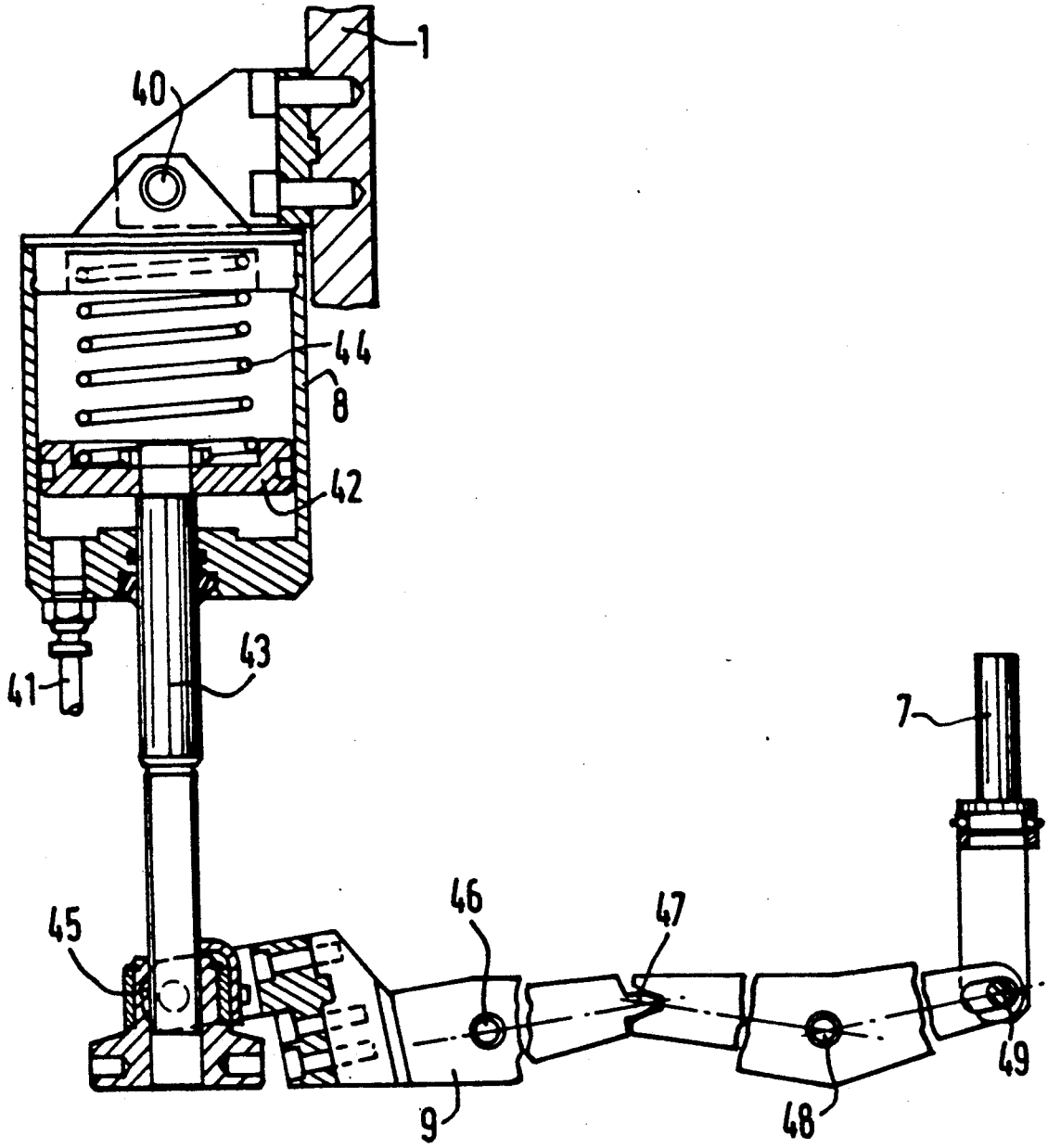
Figure 5:
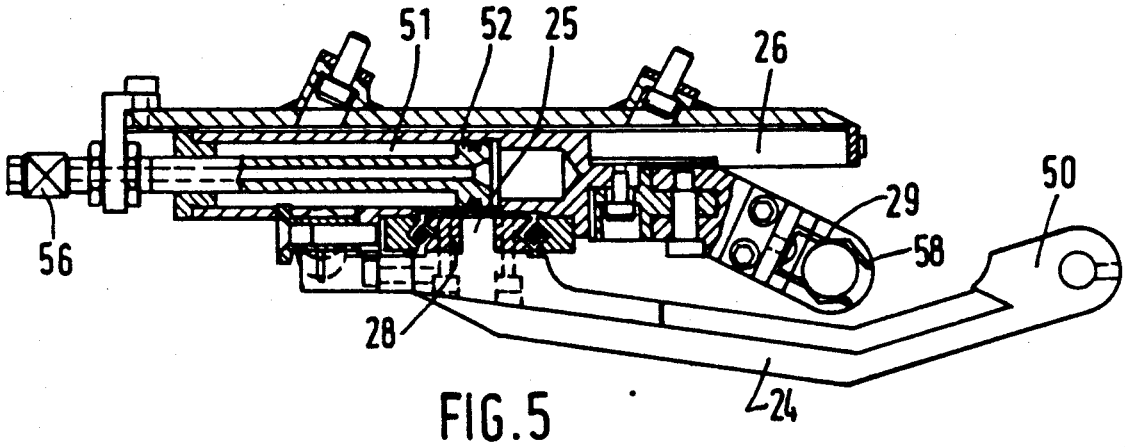
Figure 6:
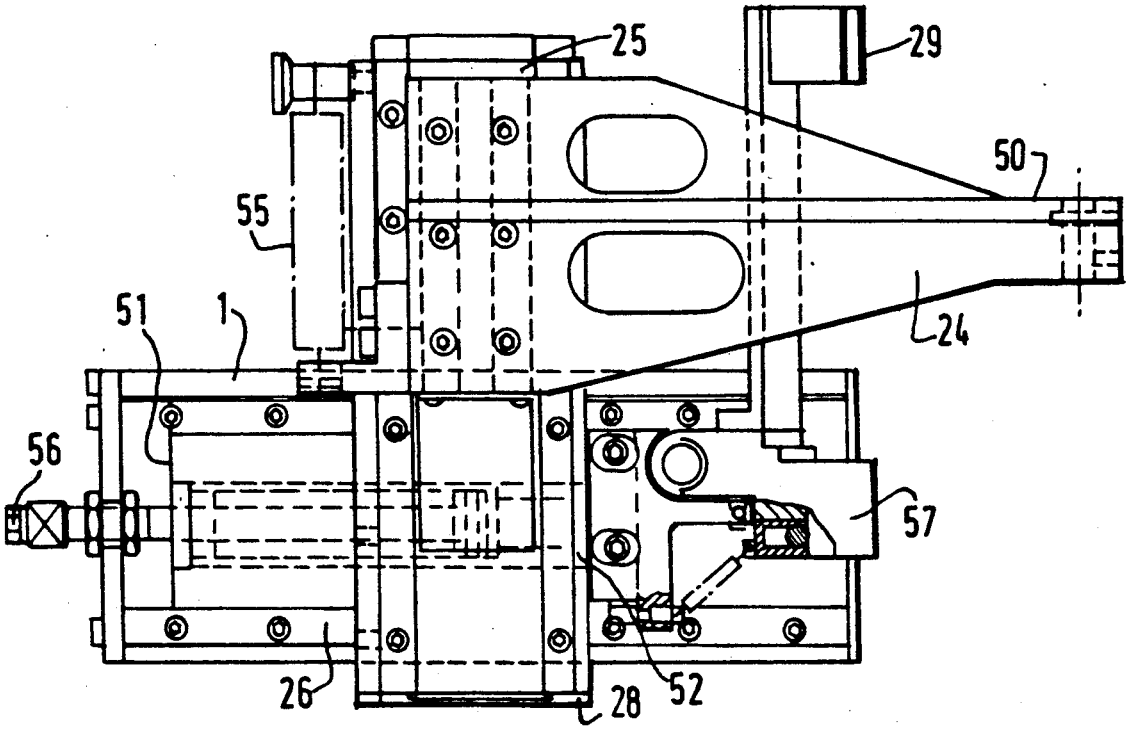
Figure 7:
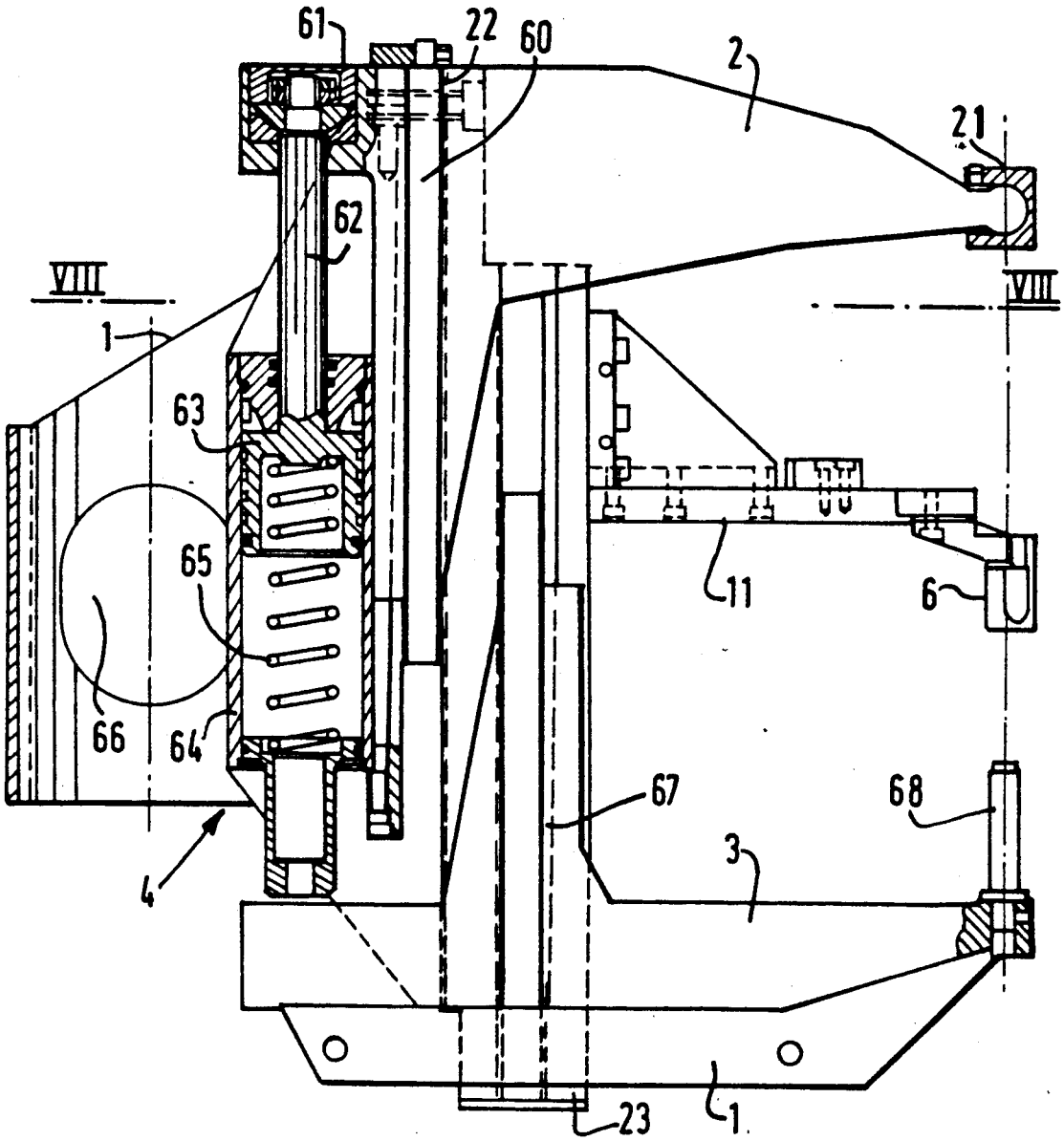

Other features and advantages of this invention will become apparent in the course of the description of a particular implementation of the concept which follows below; this description is included here as an illustrative and not limitative example in association with the figures showing the following:

FIG. 1: a side view of the drilling/riveting head;

FIG. 2: a top view of the same head;

FIG. 3: a vertical section view of the drilling head;

FIG. 4: a view showing the pressure device on the parts to be riveted;

FIG. 5: a top view of the rivet feeder arm seen in section;

FIG. 6: a front view of the device shown in FIG. 5;

FIG. 7: the riveting head shown in part section;

FIG. 8: a horizontal section view along line VIII—VIII of FIG. 7.

As is apparent in FIGS. 1 and 2, the working head possesses an obvious "C" shape comprising a frame 1 having at its two extremities an upper arm 2 and a lower arm 3 capable of travelling along slide tracks which are an integral part of frame 1. The travelling of arms 2 and 3 is obtained by means of two hydraulic jacks 4 and 5 (see FIG. 8); only jack 4 of upper arm 2 is shown in FIG. 2. The purpose of these hydraulic jacks is to exert the pressure necessary for the compression set of the rivet: the forward part of arm 2 forms the rivet hammer 21 operating along the working axis which is indicated in the figure by means of a broken line. The thrust component acting as a rivet anvil is carried by arm 3. Arms 2 and 3 travel along slide tracks 22 and 23 (see FIG. 2).

However, in the course of a riveting cycle it is important that the metal sheets to be assembled should be kept firmly pressed together. Firmly pressing the sheets together aids in avoiding the production of burrs during the drilling operation which compromises the quality of the seal between the metal plates.

To achieve this, the parts to be riveted are clamped between the upper jaw 6 and the lower jaw 7 of a plate grip. Plate grip 6 is mounted on a plate 11 fixed to machine frame 1 and possesses an opening 12 allowing rivets and the drill bit to pass through. Plate grip 7 is capable of vertical travel and is driven by compressed-air thrustor 8, the piston rod of which is fixed to levers 9 mounted on pivots on frame 1. A set screw 10 allows adjustment of the gap between jaws 7 and 6 of the plate grip according to the thickness of the sheet metal to be riveted.

The drill head can be seen in FIG. 1, indicated generally here by the reference number 14, equipped with a tool 13 of drill-bit type.

As is more apparent in FIG. 2, in which the upper arm is not shown, drill 14 is fixed to a slide 15 travelling along, firstly, track 16 which is orthogonal to the working axis and, secondly, along track 17 along an axis perpendicular to that of track 16. Drill 14 is in this way capable of travel in two perpendicular directional axes since track 16 is, according to a distinctive feature of this invention, at an angle in respect to the symmetrical axis of the riveting head (not shown).

Symmetrically, the rivet feeder 24 and upper rivet set 69 arm (see FIG. 1) is mounted on a slide 25 able to travel in one direction along track 26 driven by a thrustor and in another direction, along track 28, perpendicular to that of track 26.

As before, track 26 is arranged at an angle to the symmetrical axis of the working head and the two slide tracks 25 and 26 form together an angle of approximately 70°. The consecutive travelling motion of slide 15 followed by slide 25 allows, firstly, drilling of the metal plates and then the insertion of the rivet in the hole which has just been bored. Fitting 29 can also be seen in FIG. 2; this terminates the rivet feeder tube as described below. Rivets of appropriate size for each operation and selected by means of devices of known type, such as vibratory feeder-bowls for example, arrive through tube 70 (see FIG. 2) at tube termination 29. The riveting head is also appropriately equipped with means 71 and 72 allowing the placing in the rivet hole, which may or may not be countersunk, a sealant which is compressed between the underside of the rivet head and the upper metal plate when the rivet is set.

Drill 14 is shown in section view in FIG. 3. In this figure it can be seen that the drill chuck 31 is fitted with a tool 13 allowing the drilling of the two metal plates which are to be assembled and, if desired, the countersinking of the hole in upper metal sheet in order to form a seating for the rivet head. The rotation of shaft 32 of the drill is ensured by a gear 33 which is itself mechanically coupled to a set of gears 34. The center shaft of gear 34, which is the furthest away from hub 33, is driven by a compressed-air motor 35 connected to a supply of compressed air by a socket fitting 36.

After the bit has been set in rotary motion, penetration of drill bit 13 into the sheet metal is ensured by application of force by the rivet hammer 21 (see FIG. 1) against pressure plate 37 when drill bit 13 has been brought into the working axis by travelling along slide track 16.

As has been mentioned above, drill head 14 is fixed to a slide 15 capable of vertical travel (in the figure) along track 17. After descending and drilling the metal plates, the drill is pulled back up by a spring 38 connected between slide 15 and point 39 on the track as soon as the pressure on arm 2 has been released. Thus, after the return of arm 2, spring 38 pulls drill 14 back up along slide track 17. It can then move along track 16, thereby clearing the working axis for the insertion of a rivet.

FIG. 4 is a detail view showing the control mechanism of the lower jaw of the plate grip 7. As has already been mentioned, pressure on the metal sheets is ensured by a compressed-air thrustor 8 mentioned on pivot pin 40, which is fitted in a sleeve fixed to frame 1. Thrustor 8 is supplied with compressed air by means of a regulating nozzle fitting 41 which applies pressure to piston 42 which is fitted rod 43. Piston 42 is equipped with a return spring 44. On head 45 of the piston rod 43 is fitted a lever 9 turning around pin 46 which works via a single-toothed gear 47 in conjunction with another lever 9, pivoted at 48. A second lever 9 is itself pivoted at 48 on the mounting 49 of the lower jaw of plate grip 7. Thus, when compressed air is introduced through nozzle 41, piston 42 rises within the cylinder, causing the first lever 9 to rotate clockwise, which in turn cause the rotation in an opposite direction of the second lever 9 through single-toothed gear 47, and this has the result of causing the upward movement of jaw 7 of the plate grip. This latter movement continues until sufficient pressure on the lower of the metal sheets has been achieved.

FIGS. 5 and 6 show the mechanism for bringing rivets into the working axis for compression setting.

The component parts already described above can be seen in FIGS. 5 and 6: rivet transfer arm 24 fitted to slide 25 on slide track 28 which itself can travel along track 26. Arm 24 has an outer termination consisting of a clamp or tongs attachment 50 under which can be seen the upper rivet set 69 (not shown in FIGS. 5 and 6). Slide 25 is moved by injection of compressed air into cylinder 51 through socket fitting 56; the air causes the displacement of a piston 52 fitted to tracks 28 on which travels slide 25 carrying arm 24. Arm 24 is terminated by a pincer grip 50 intended for the picking up of rivets arriving through tube 70 (see FIG. 2) at tube termination 29. When there is a rivet at point 29 in the tube, from the position shown in FIGS. 5 and 6, the piston 52 withdraws so as to bring rivet grip 50 immediately under the entrance 29 of the tube; the grip seizes the rivet by its lower section and brings it into the working axis. In this way, the rivet is clamped in position throughout the operation, which makes it possible to work with the riveting head in any position. When the rivet is directly over the hole drilled in the metal plates, the upper rivet set 69 (see FIG. 1) is pushed down by arm 2, thereby freeing the rivet from clamp 50. At this point the slide returns to pick up the next rivet.

As has already been mentioned, the insertion of the rivet into the intended hole is effected by the descent of arm 2, freeing the rivet from grip 50. As in the case of the drill, the arm 24 carrying the rivet grip is pulled back up by a spring 55 fitted between the slide 25 and a fixed point on track 28. The rivet feeder tube 29 is equipped with two springs 58 for retention of the rivet.

FIGS. 7 and 8 are detail views showing the assembly of the upper and lower arms 2 and 3 respectively which apply the pressure necessary not only for the drilling operation, using arm 2, but also for the riveting operation itself, using arms 2 and 3. The pressure for the latter operation is applied on the lower and upper rivet sets 68 and 69 respectively. Rivet set 68 passes through plate grip 7, while die 69 passes through plate grip 6.

As has been previously mentioned, arm 2 is mounted in a manner such that it is capable of travelling along a track 22 on the machine frame, and fitted at one end to a slide 60 and at the other to the head 61 of the rod 62 of piston 63 driven by oil under pressure in cylinder 64; spring 65 pulls the arm back and up when the oil pressure is released. Frame 1 also has an opening 66 to bring through the cabling and tubing necessary for the functioning of the drilling and riveting head, which is itself mounted on a robot arm or analogous equipment.

As is apparent in FIG. 7, arm 3 travels along track 23 driven by cylinder 5 (not shown), and this arm 3 is fitted to a piston rod mounted on an axis opposed to that of piston 62. In this way, the application of pressure, notably in the course of a riveting cycle, is kept constantly balanced; that is to say that the compression force applied to the rivet is the result of the combined action of two forces exerted in opposed directions. The compression set of the rivet is in this way carried out by a much smoother build-up of force than with one arm of "C" configuration operating as a hammer and the other as anvil.

At the end of arm 3, which is located in the working axis the lower rivet set 68 which compress-sets the rivet can be seen. Arm 3 travels along track 23 on slide 67.

The cycle for a complete drilling and riveting operation is as follows:

The head approaches from either side the two metal plates A and B (see FIG. 1) to be riveted, clamping them in place with pressure exerted by air thrustor 8 between the jaws 6 and 7 of the plate grip. The sheets will remain thus clamped together throughout the entire cycle. The first phase is then the drilling of a rivet hole through the metal sheets. In order to carry this out, drill head 14 travels along track 16 to bring drill tool 13 into the working axis. The compressed air motor 35 is then started, and this rotates the drill bit 13. Simultaneously, arm 2 begins its descent and head 21 comes up against surface 37 of the drill 14 such that the latter travels down track 17 and drills the hole; drill bit 13 passes through opening 12. Tool 13 may drill a hole which is either simple or countersunk according to its shape. When pressure in cylinder 4 is released, spring 65 pushes piston 62 back and up and arm 2 lifts back. In the same way, spring 38 pulls drill 14 back up to its top position, after which the drill runs back along track 16, clearing the working axis. A sealant may then be injected into the drilled hole.

A rivet at the upper level of tube termination 29 is then picked up in pincer grip 50. Arm 24 moves toward the working axis along track 26. When the rivet has been brought in line with opening 12, arm 2 comes back down along with upper rivet set 69 which has come forward into the working axis. With the continuation of the descent of arm 2, the upper rivet set 69 comes up against the head of the rivet, pushed by rivet hammer 21. Simultaneously, lower arm 2 rises to bring the lower rivet set 68 up against the lower end of the rivet. The simultaneous application of pressure by hydraulic jacks 4 and 5 causes the plastic deformation by compression of the rivet and the consequent attachment of the two metal sheets at the point under consideration. Arms 2 and 3 then return to their back position, the head moves and a new operating cycle begins.

I claim:

1. A computer-controlled device for automatic drilling and riveting in confined areas comprising a support frame, said frame having a generally "C" shape and having at its two extremities an upper arm 2 and a lower arm 3, said arms being capable of movement along tracks 22 and 23 on said frame, the upper arm 2 terminating in a riveting hammer 21 and the lower arm 3 in a rivet set, said upper and lower arms being driven by jacks 4 and 5, said frame having an upper jaw 6 and a lower jaw 7 to clamp the components to be riveted, upper jaw 6 being mounted on plate 11 which possesses an opening 12 to allow rivets and a drill bit to pass therethrough said lower jaw 7, being capable of vertical travel, said frame having a means 14 for drilling said components, said drill means 14 being fixed to a slide 15 which is capable of travel along track 16 which is orthogonal to a working axis and along track 17 which is perpendicular to track 15, said drilling means having connected thereto a means to feed rivets to said rivet hammer 21 said rivet hammer being capable of applying force to said drilling means during drilling operations.

2. A device according to claim 1 wherein the means for drilling (14) and the upper rivet set (69) are fitted to slides (15,25) travelling along tracks (17,28) parallel to the working axis, said slide tracks (17,28) being fitted such that they may slide along tracks (16,26) perpendicular to tracks (17,28), these tracks (16,26) forming together an angle of less than 90°.

3. A device according to claim 2 wherein track 26 is arranged at an angle to the symmetrical axis of the working head and the two slide tracks 25 and 26 form together an angle of approximately 70°.

4. A device according to claim 2 in comprising a fitting (29) terminating a rivet-feeder tube (70), a rivet pincer grip (50) fitted to a mounting (24) capable of movement between the working axis and a position located under the tube termination (29).

5. A device according to claim 4 in which the hammer (21) of the arm (2) comes up against, in turn, a pressure plate (37) on the drill head (14) and the upper surface of the rivet set (69).

6. A device according to claim 5 wherein the jaw (7) of the plate grip travels along the working axis driven by a compressed air thrustor (8) through levers (9) fitted to pivots on frame 1.

7. A device according to claim 6 wherein arms (2,3) travel along tracks (22,23) driven by hydraulic jacks (4,5).

8. A device according to claim 7 wherein the rivets picked up at the tube termination (29) are maintained in correct position by the rivet pincer grip (50).

9. A device according to claim 8 wherein drill means 14 has a drill chuck 31 fitted with a tool 13 allowing the drilling of the two components to be assembled.

10. A device according to claim 8 wherein a first lever rotates clockwise when compressed air is introduced, said rotation of lever causing rotation in an opposite direction of a second lever, said rotation causing upward movement of jaw 7.

11. A device according to claim 10 wherein said means to feed rivets further comprises a rivet transfer arm 24 fitted to slide 25 on slide track 28, slide 25 being capable of movement by injection of compressed air into a cylinder 51, said air causing displacement of a piston 52 fitted to said track 28.

* * * * *